US012246894B1

(12) United States Patent
Rodriguez, Jr.

(10) Patent No.: US 12,246,894 B1
(45) Date of Patent: Mar. 11, 2025

(54) CONTAINER HAVING LID WITH OUTWARDLY FACING DISPLAY PANEL

(71) Applicant: Raul Rodriguez, Jr., Madera, CA (US)

(72) Inventor: Raul Rodriguez, Jr., Madera, CA (US)

( * ) Notice: Subject to any disclaimer, the term of this patent is extended or adjusted under 35 U.S.C. 154(b) by 0 days.

(21) Appl. No.: 17/331,575

(22) Filed: May 26, 2021

(51) Int. Cl.
*B65D 51/24* (2006.01)
*B65D 43/16* (2006.01)
*F25D 3/08* (2006.01)

(52) U.S. Cl.
CPC ..... *B65D 51/245* (2013.01); *B65D 43/16* (2013.01); *F25D 3/08* (2013.01)

(58) Field of Classification Search
CPC .... B65D 5/425; B65D 5/4216; B65D 5/4212; B65D 51/245; F25D 3/08; A47G 1/143; A47G 2001/146
USPC ..... 206/459.5, 460, 459.1, 216, 45.24; 220/521, 915.2, 592.2, 915.1; 248/475.1, 248/274.1; 40/102, 4.01–124.191
See application file for complete search history.

(56) References Cited

U.S. PATENT DOCUMENTS 1,308,949 A * 7/1919 Harris et al. ..... B65D 5/5206 206/45.24
1,421,964 A * 7/1922 Langford ..... B65D 51/245 40/649
4,452,416 A * 6/1984 Templeton ..... G09F 1/10 40/607.04
4,648,512 A * 3/1987 Tarozzi ..... A45C 11/20 206/541
4,884,718 A * 12/1989 Leahy ..... B65D 75/225 220/839
5,265,541 A * 11/1993 Gordon ..... A47B 23/001 108/34
5,447,041 A * 9/1995 Piechota ..... A45C 15/00 312/405.1
5,755,180 A * 5/1998 Smith ..... A01K 13/00 40/725
5,975,334 A * 11/1999 Mayo ..... A45C 11/20 220/592.2
5,979,175 A * 11/1999 Ellison ..... A45C 15/00 62/457.7
6,152,417 A * 11/2000 Randall ..... A47B 23/001 248/456
6,540,192 B2 * 4/2003 Ouellet ..... A47B 97/04 248/447
7,140,507 B2 * 11/2006 Maldonado ..... A45C 11/20 220/592.2

(Continued)

*Primary Examiner* — Steven A. Reynolds
*Assistant Examiner* — Prince Pal
(74) *Attorney, Agent, or Firm* — Richard A. Ryan

(57) ABSTRACT

A container having sidewalls that define an interior area for receiving items inside the container and a container lid to close the items inside the interior area of the container. The container lid has a recessed area in its upper surface. The container has a display panel with a display surface on which identifying information describing the items in the container is displayed. The display panel is received in the recessed area when not in use and is moved to a raised position to display the identifying information to prevent persons from unnecessarily opening the lid when seeking an item that is not in the container. A support assembly supports the display panel in the raised position. A writing instrument for writing the identifying information can be attached to the display panel with a clip or other securing mechanism. In one configuration, the container is an ice chest.

17 Claims, 6 Drawing Sheets

(56) References Cited

U.S. PATENT DOCUMENTS 7,252,195 B2 * 8/2007 Mandle ..... A47L 13/51 206/812
7,604,290 B1 * 10/2009 Giordano ..... A47C 3/32 297/188.1
7,677,406 B2 * 3/2010 Maxson ..... B65D 81/3823 220/592.2
7,905,038 B2 * 3/2011 Coff ..... A47J 41/00 40/307
8,878,637 B2 * 11/2014 Sartee ..... G06F 1/1677 361/679.01
9,259,090 B1 * 2/2016 Cronin ..... A47C 1/146
9,726,424 B1 * 8/2017 Sandberg ..... A45C 11/20
9,732,550 B2 * 8/2017 Lubotta ..... E05G 1/08
10,053,274 B1 * 8/2018 O'Neill ..... B65D 5/4291
10,234,192 B2 * 3/2019 Tang ..... F25D 3/08
10,731,919 B1 * 8/2020 Gutierrez ..... F25D 27/005
11,278,133 B2 * 3/2022 Miller ..... A47G 1/143
2002/0104941 A1 * 8/2002 Pfister ..... F16M 13/02 248/274.1
2003/0106979 A1 * 6/2003 Richardson ..... A47B 97/08 248/460
2006/0261654 A1 * 11/2006 Stallman ..... A47C 15/004 297/310
2006/0266904 A1 * 11/2006 Crum ..... B62B 3/1416 248/274.1
2007/0084743 A1 * 4/2007 Chu ..... B65D 43/0222 206/455
2007/0193297 A1 * 8/2007 Wilson ..... F25D 29/00 62/457.2
2008/0156815 A1 * 7/2008 Coff ..... A47J 41/00 220/592.2
2008/0245793 A1 * 10/2008 Hanson ..... A45C 11/20 220/592.2
2008/0264943 A1 * 10/2008 Klure ..... B65D 43/0218 220/212
2009/0019738 A1 * 1/2009 Cunningham ..... B43K 23/001 40/1
2010/0263399 A1 * 10/2010 Pollina ..... F25D 3/08 62/331
2011/0248033 A1 * 10/2011 Mehrvijeh ..... B65D 51/28 220/254.3
2011/0310548 A1 * 12/2011 Ahn ..... F16M 11/10 248/346.06
2012/0012488 A1 * 1/2012 Schweinberg .... B29C 66/02242 156/70
2012/0247983 A1 * 10/2012 Maravilla ..... G06F 1/1628 206/216
2014/0051058 A1 * 2/2014 Rhodes ..... B43K 23/08 434/422
2014/0151524 A1 * 6/2014 Katterheinrich ..... F16M 13/00 248/456
2014/0315667 A1 * 10/2014 Manner ..... A63F 9/001 206/216
2015/0024369 A1 * 1/2015 Brown ..... G09F 21/026 434/416
2015/0122827 A1 * 5/2015 Smith ..... B65D 25/32 220/592.2
2017/0082342 A1 * 3/2017 Weinberg ..... B65D 25/2805
2017/0234596 A1 * 8/2017 Patsis ..... H04R 1/028 220/592.2
2018/0208360 A1 * 7/2018 Brinkworth ..... B67D 1/1477
2018/0222246 A1 * 8/2018 Martin ..... B43L 1/008
2019/0092087 A1 * 3/2019 Schorr, III ..... B43L 1/00
2019/0175868 A1 * 6/2019 Spens ..... A61B 50/30
2019/0241349 A1 * 8/2019 Pearson ..... B65D 81/3813
2020/0175895 A1 * 6/2020 Durst ..... G09F 23/0058
2020/0217575 A1 * 7/2020 Thelin ..... F25D 29/003
2020/0317411 A1 * 10/2020 Reiley ..... B65D 51/28
2022/0071454 A1 * 3/2022 Pyle ..... A47J 47/02
2022/0144504 A1 * 5/2022 Reiley ..... B65D 51/1644

* cited by examiner

CONTAINER HAVING LID WITH OUTWARDLY FACING DISPLAY PANEL

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to containers that are utilized to store one or more items therein. In particular, the present invention relates to such containers that have a lid which is moved between a closed position so as to enclose the items in an interior area of the container and an open position to allow removal of one or more of the items from the interior area of the container. Even more particularly, the present invention relates to such containers and to indicator devices and mechanisms that are associated with the exterior of the container to indicate what items are stored inside the container without having to open or remove the lid.

B. Background

Containers for receiving and storing one or more items in an interior area of the container are commonly utilized for a wide variety of purposes and to store a wide variety of different types of items. As well known, such containers can be obtained in a variety of different sizes and can be manufactured out of a variety of different materials, with the sizes and materials often being chosen in light of the items which will be placed and stored in the containers. The typical container has a container body with a bottom wall and one or more sidewalls that define an interior area in which the items are received and a lid which encloses the items inside the interior area of the container. Whether the lid is attached to one of the sidewalls of the container body or is not attached, the lid is configured to allow a person to access the interior area to add or remove items therefrom. In some configurations of containers, the lid removably engages the upper edges of the sidewalls in a manner which, typically, secures the lid to the container body. In other configurations, the lid is pivotally attached to one or more of the sidewalls of the container body so as to move between a closed position at the upper ends of the sidewalls and an open position with the lid in spaced apart relation to the sidewalls.

As set forth above, the bottom wall, sidewalls and lid of a container are usually made out of materials and configured in a manner that allows the container to effectively hold certain types of items. For instance, for many types of uses of a container, it is beneficial that the bottom wall, sidewalls and lid be solid so as to enclose items therein without loss of the items or other materials inside the interior area of the container body. The solid walls and lids of a container can be made out of flexible materials, such as leather, cloth, flexible plastic and the like, or out of stiff and rigid materials, such as metal, rigid plastic or rubber, glass and the like. The walls and lid of some containers are made out of materials that help insulate the interior area to help keep the items therein warm or cold.

Most often, the walls and lids of a container are made out of materials that do not allow a person to see through the walls or lid into the interior area of the container body (with glass or transparent plastic walls or lid being an exception) and, as result, will require opening of the lid, by removal or pivoting thereof, in order for a person to see the items inside the interior area of the container body. Depending on the use of the container, this may be a minor inconvenience or it may be a major limitation to use of the container. An example of a container that has the walls and lid made out of a solid material which is configured to keep the items in the interior area warm or cold is commonly referred to as an "ice chest". The walls and lid of these containers are usually made out of solid, non-transparent insulated material that retains the heat or cold (most often) inside the container so as to keep the items warm or cold. Usually, ice or other cold substances are also placed inside the interior area to keep the interior area and the items therein cold. The walls and lid and the relationship between the lid and the container body of the typical ice chest is configured to reduce heat loss through the walls and lid so as to keep the items being stored in the container cold when the lid of the container is in its closed position. As well known by persons who utilize ice chests, every time the lid is moved to its open position, whether by removal or pivoting, some of the cold air in the interior area is lost to the environment and melting of the ice or other cold substance is increased, thereby reducing the amount of time the items will be able to be kept cold inside the interior area of the ice chest. A certain amount of loss of cold air and warming of ice is inevitable due to the need to open the lid and remove an item, which may be a food and/or drink, from the ice chest. As well known by users of ice chests, the more frequently the lid is opened and the longer time which the lid is left open by someone seeking an item, the more cold air is lost to the environment and the faster ambient air will melt the ice. As a result, most ice chest users attempt to reduce the unnecessary opening of the lid and the amount of time the lid is kept open.

One issue working against the user with regard to keeping the lid in its closed position is that fact that people opening the ice chest often have to keep the lid open while looking in the ice chest for the item they desire. This problem is compounded by the fact that the walls and lid of an ice chest are non-transparent. The likelihood of the ice chest being open for extended periods of time is increased when there are more than one ice chest, such as at a party, reunion, large picnic and the like. In such situations, each ice chest may contain related but different items, such as is common for cold storage of drinks (i.e., soda, diet soda, beer and the like). Absent any identification labels or the like on or otherwise associated with the multiple ice chests, a person approaching one of the ice chests will not know what type of drink is in the ice chest. As a result, he or she will open the lid and have to look around, often having to move ice and/or items aside, inside the interior area to see what type of item is stored in the ice chest. The opening and looking around in the "wrong" ice chest results in needless loss of cold air from the interior area and melting of the ice in the interior area, which will ultimately cause the items to undesirably warm up.

To reduce this needless loss of cold air and melting of the ice, people who use multiple ice chests that each hold different types of items will identify what items, or at least a class of items, are inside each ice chest. The mechanism for identifying the items inside an ice chest can take on many forms, including those that are separate from the ice chest, such as a sign on a post, tree or other object, and those that are attached to or placed on the ice chest. With regard to the latter, the identification mechanism can be a placard or sign that is placed on top of the lid of the ice chest or which is attached to the container body of the ice chest, such as by using tape, glue or the like. Alternatively, the identification mechanism can be just the tape or other attachable material that is stuck onto a sidewall of the container body. In either of these configurations, a description of the item or the class of items is written or otherwise placed on the placard/sign or directly onto the tape or other attachable material to reduce the need to open the lid just to see what is inside the ice chest, which opening may be repeated for different ices chests by each user seeking an item. The problem with the use of a placard or sign on top of the lid of the ice chest is that the placard/sign can be knocked off of the lid by the wind or other action (i.e., being knocked off by a person or dog passing nearby) or can fall off of the container by a person who opens the lid to retrieve an item from inside the interior area of the container. With regard to writing a description on a piece of tape or other attachable material, this will usually require the user to obtain a new piece of attachable material for each event or go through the effort of using the same ice chest with the same items, which is often very difficult to accomplish. In addition, another disadvantage of using an attachable material as the base on which the identifying information is written is that the attachable material will have to be stuck onto the outside surface of one or more sidewalls or the lid, which surface can be, at least visually, damaged by removal of the attachable material or otherwise impaired by incomplete removal (i.e., the glue portion) of the attachable material from the ice chest. As will be readily appreciated by users of ice chests, repeatedly removing tape or other attachable material from an outer surface of an ice chest increases the likelihood of such damage. Although the labeling of the ice chest with an attachable material generally solves the problem of a placard or label being knocked off otherwise becoming separated from an ice chest and beneficially identifies the items in the ice chest, most people do not want this type of damage to their ice chest just to accomplish the desired identifying objective.

What is needed, therefore, is an improved container that is provided with an indicator device which is configured to indicate the type of items that are stored inside an interior compartment of the container. More specifically, what is needed is a new and improved container that has a bottom wall and one or more sidewalls defining an interior area, a lid enclosing the interior area and an indicator device that is configured to indicate the type of items which are in the interior area so as to reduce the need to open the container to determine what items are in the interior area. The new indicator device should be associated with the lid of the container and configured to be moved between a lowered position for ease of moving and storing the container and a raised position allowing persons to see the indicator device and the item description on the indicator device. The container lid should be configured to safely store the indicator device out of the way when the indicator device is in its lowered, non-use position. The indicator device should comprise a display surface that can have the item description written or otherwise placed thereon so as to be seen by persons viewing the container. The indicator device should have a support assembly that is configured to support the indicator device on the lid in its raised position and to be collapsed or otherwise moved so the container can be moved and stored. The new container having an indicator device should be adaptable for use with a wide variety of container uses, including as an ice chest that is used to keep items cool or warm. The indicator device of the new container should be easy to use and effective at displaying the information describing the items that are stored in the interior area of the container to help the users determine whether or not the desired items are inside the container prior to opening the lid of the container. Preferably, the new container having an indicator device should be relatively inexpensive to manufacture so as to be widely available for use.

SUMMARY OF THE INVENTION

The following presents a simplified summary of the disclosure of the present invention in order to provide a basic understanding of the invention to the reader. As such, this Summary is not an extensive overview of the disclosure and it does not identify key/critical elements of the invention or delineate the scope of the invention. The sole purpose of this Summary is to present some concepts disclosed herein in a simplified form as a prelude to the more detailed description that is presented later.

The use of terms such as “including”, “comprising” or “having” and variations thereof herein is meant to encompass the items listed thereafter and equivalents thereof. The terms “a” and “an” herein do not denote a limitation of quantity, but rather denote the presence of at least one of the referenced items. Further, the use of terms “first”, “second”, and “third”, and the like, herein do not denote any order, quantity, or importance, but rather are used to distinguish one element or feature of an element from another. The term “and/or,” when used herein with a list of two or more items, means that any one of the listed items can be employed by itself, or any combination of two or more of the listed items can be employed.

The new container having a lid with a forward facing display panel of the present invention provides the benefits and solves the problems identified above. That is to say, the present invention is directed to a new and improved container having a bottom wall and one or more sidewalls that define an interior area of the container, a lid which selectively encloses the interior area of the container and a display panel that has a display surface which is utilized to indicate the type of items that are in the interior area of the container so as to reduce the need to open container to determine what items are in the interior area. The display panel is associated with the lid of the container and configured to move between a first or forward facing raised position that allows people to easily see the item description which is placed on the display surface of the display panel and a second or lowered position that enables persons to move and store the container without damaging the display panel. Preferably, the container lid has a recessed area on its upper surface that is sized and configured to receive the display panel therein so as to safely store the display panel below the plane of the upper surface of the lid when the display panel is in its lowered (typically non-use) position. The display panel has an outwardly facing display surface that is selected to have the item description written or otherwise placed thereon so as to be seen by persons viewing the container. The new container of the present invention has a support assembly that is associated with the container lid and the display panel and which is configured to support the display panel on the container lid in the panel's raised position and to be collapsed or otherwise manipulated to place the display panel in its lowered position so the container can be moved and stored without damaging the display panel. The new container of the present invention can be readily adapted for a wide variety of different types of container uses. The display panel and support assembly of the new container are easy to use and effective at allowing the user of the container to display information which describes the items that are stored in the interior area of the container in a manner which will help other persons determine whether or not their desired item is inside the container without having to open the lid of the container and look inside the container. In the preferred configurations of the present invention, the new container is relatively inexpensive to manufacture so as to be widely available for use.

In one of the preferred embodiments of the present invention, the new container is configured for use as an ice chest that is made out of materials which are selected to keep the items inside the interior area thereof cold and/or warm. As is typical for ice chests, the ice chest has a lid which is either pivotally attached to one of the sidewalls of the container body by one or more hinges or the like or the lid is removably engaged with the upper edge of the sidewalls so as to close the interior area thereof. The recessed area for the display panel is formed, cut or otherwise provide in the upper surface of the container lid and is sized and configured in a manner which allows the user of the container to easily move the display panel between being supported by the support assembly in its raised position and being inside the recessed area when in its lowered position. When the display panel is in its lowered position inside the recessed area, the outward display surface thereof is below the upper surface of the container lid so the display panel will not interfere with the transport or storage of the container and to reduce the likelihood of damage to the display panel during such transport or storage.

In one embodiment of the present invention, the new container generally comprises a container body defining an interior area of the container, a container lid associated with the container body, a recessed area in the container lid, a display panel moveably associated with the container lid to display identifying information about items that are stored in the interior area and a support assembly associated with the display panel for supporting the display panel in a manner in which people can easily read the identifying information. The container body has one or more sidewalls that define the interior area inside the container body. The container lid is sized and configured to engage the container body and enclose the items inside the interior area of the container. The container lid has an upper surface and a lower surface, with the upper surface of the container lid defining a lid plane along the upper surface. The recessed area, which is in the upper surface of the container lid, has one or more sidewalls that define a recess surface that is in spaced apart relation below the lid plane of the container lid. The display panel is sized and configured to be received in the recessed area of the container lid below the lid plane of the container lid when the display panel is in a lowered position. The display panel has an outwardly facing display surface on which is placed identifying information that is selected to identify the items inside the interior area of the container. Preferably, the identifying information is selected so as to be at least generally in corresponding relation to the items placed in the interior area of the container The support assembly is associated with each of the display panel and the container and is structured and arranged to selectively support the display panel in a raised position above the container lid so as to easily and conveniently display the identifying information on the display surface.

The display panel is sized and configured to be at least substantially horizontally disposed in the recessed area of the container lid when the display panel is in its lowed position. In the preferred embodiments, the display panel and the recessed area are cooperatively sized and configured so the display panel can positioned below the lid plane along the upper surface of the container lid when the display panel is in its lowered position. The recessed area can have one or more raised sections that define an upper cavity and a lower cavity in the recessed area. The upper cavity is sized and configured to receive the display panel therein when the display panel is in its lowered position and placed on a raised surface of at least one of the one or more raised sections. The lower cavity, which is disposed between the display panel and the recess surface when the display panel is in the lowered position, is sized and configured to store the support mechanism therein when the display panel is in its lowered position.

In one embodiment, the support assembly is attached to or integral with the recess surface in the recessed area and/or the display panel. In one of the preferred embodiments, the display surface is on a front side of the display panel and the support assembly is attached to or integral with a back side of the display panel. In the preferred embodiments, the support assembly is structured and arranged to be in a collapsed condition for storing the support assembly when the display panel is in is lowered position and be in an extended condition for supporting the display panel in its raised position. Preferably, depending on the materials utilized for the display surface, the container further comprises a writing instrument and a securing mechanism for securing the writing instrument to the back side of the display panel. In the embodiment where the recessed area is divided into cavities, the lower cavity is also sized and configured to receive the writing instrument and the securing mechanism therein.

Accordingly, the primary object of the present invention is to provide a new container that has the advantages are set forth above and which overcomes the various disadvantages and limitations which are associated with presently available containers and indicator devices that are utilized with such containers to provide information which identifies what items are stored in the container.

It is an important object of the present invention to provide a new container that has a container lid which is provided with an indicator device that is utilized to indicate what items are enclosed inside the container.

It is also an important object of the present invention to provide a new container having a container body that defines an interior area, a container lid that closes the interior area so as to store items inside the interior area and an indicator device which is associated with the container lid to identify the items or at least the type of items that are stored inside the interior area without having to lift or remove the container lid from the container body to determine what items are being stored inside the container.

An important aspect of the present invention is that it provides a new container having a lid with a display panel which accomplishes the objectives set forth above and elsewhere in the present disclosure.

Another important aspect of the present invention is that it provides a new container having a lid with a display panel which can be utilized to easily and quickly place information thereon that will allow persons to easily identify the items or type of items which are stored inside the container without the person having to raise or remove the container lid.

Another important aspect of the present invention is that it provides a new container having a container body which defines an interior area for storing one or more items therein, a container lid that selectively engages the container body to close the interior area and a display panel associated with the container lid which can be utilized to display information describing the items that are stored inside the interior area of the container.

Another important aspect of the present invention is that it provides a new container having a lid with a display panel comprising an outwardly disposed display surface on which can be written or otherwise placed information that describes the items that are stored in an interior area of the container.

Another important aspect of the present invention is that it provides a new container having a container lid comprising a recessed area in the upper surface thereof which is sized and configured to receive a display panel and a support assembly that is associated with the display panel to allow a user to move the display panel between a lowered position inside the recessed area and a raised forward facing position that allows a person to see a display surface of the display panel when standing in front of the container so he or she can determine what items are inside the container without raising or removing the container lid.

Another important aspect of the present invention is that it provides a new container having a lid which has a recessed area on its upper surface that is sized and configured to receive a display panel therein so as to safely store the display panel below the plane of the upper surface of the lid when the display panel is in its lowered (typically non-use) position to enable the user to move, stack and store the container without damaging the display panel and/or other containers.

Another important aspect of the present invention is that it provides a new container having a lid with a moveable display panel and a support assembly that is associated with the container lid and the display panel to support the display panel on the container lid in its forward facing raised position and to be collapsed or otherwise manipulated to place the display panel in its lowered position so the container can be moved and stored without damaging the display panel.

Another important aspect of the present invention is that it provides a new container having a lid with a display panel which can be readily adapted for a wide variety of different types of container uses.

Another important aspect of the present invention is that it provides a new container having a lid with a display panel and support assembly which are easy to use and effective at allowing the user of the container to display information that describes the items which are stored in the interior area of the container in a manner that will help other persons determine whether or not their desired item is inside the container without having to open the lid of the container and look inside the container.

Yet another important aspect of the present invention is that it provides a new container having a lid with a display panel for displaying information about the items stored in the container which, in a preferred configuration, is easy to use and relatively inexpensive to manufacture.

As will be explained in greater detail by reference to the attached figures and the description of the preferred embodiments which follow, the above and other objects and aspects are accomplished or provided by the present invention. As set forth herein and will be readily appreciated by persons who are skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 1:
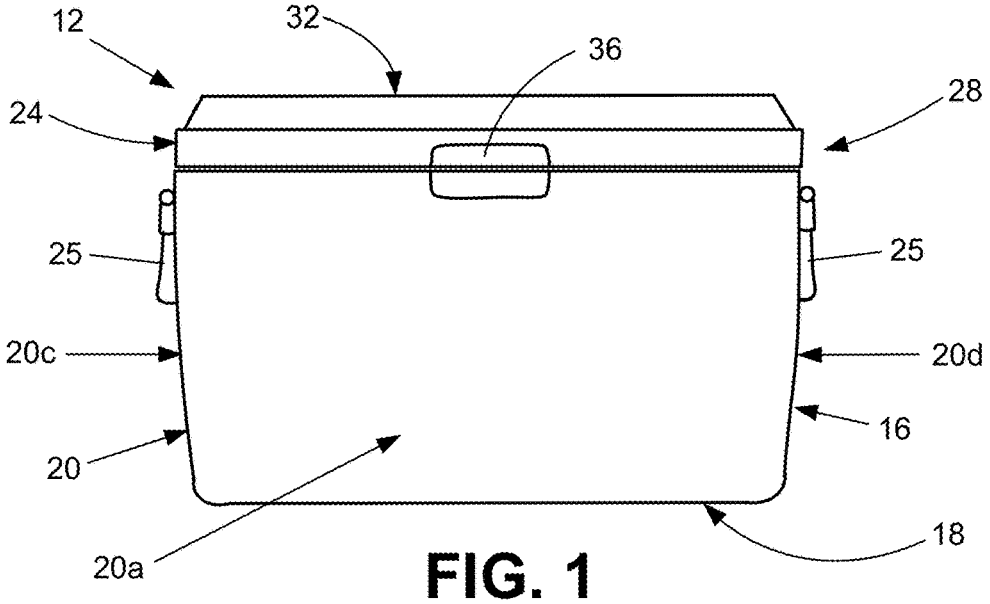
FIG. 1 (PRIOR ART)
FIG. 1 is front view of a prior art container that is configured as an ice chest to show the components of the container which are relevant to the present invention, with the container lid thereof shown in its closed position.

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular configurations for the container, display panel and support apparatus of the present invention, persons who are skilled in the relevant art will readily appreciate that the present invention is not so limited. In addition, the exemplary embodiments of the present device are shown and described with only those components which are required to disclose the present invention. As such, many of the necessary components for manufacturing and using the present invention are not shown in the drawings or necessarily described below, but which are well known to persons skilled in the relevant art. As will be readily appreciated by such persons, the various elements of the present invention that are described below may take on any form consistent with forms which are readily realized by one of ordinary skill in the art having knowledge of prior art side containers, display panels, display surfaces and support apparatuses that are configured to selectively support the display panel with its display surface in a generally forward facing manner.

Figure 2:
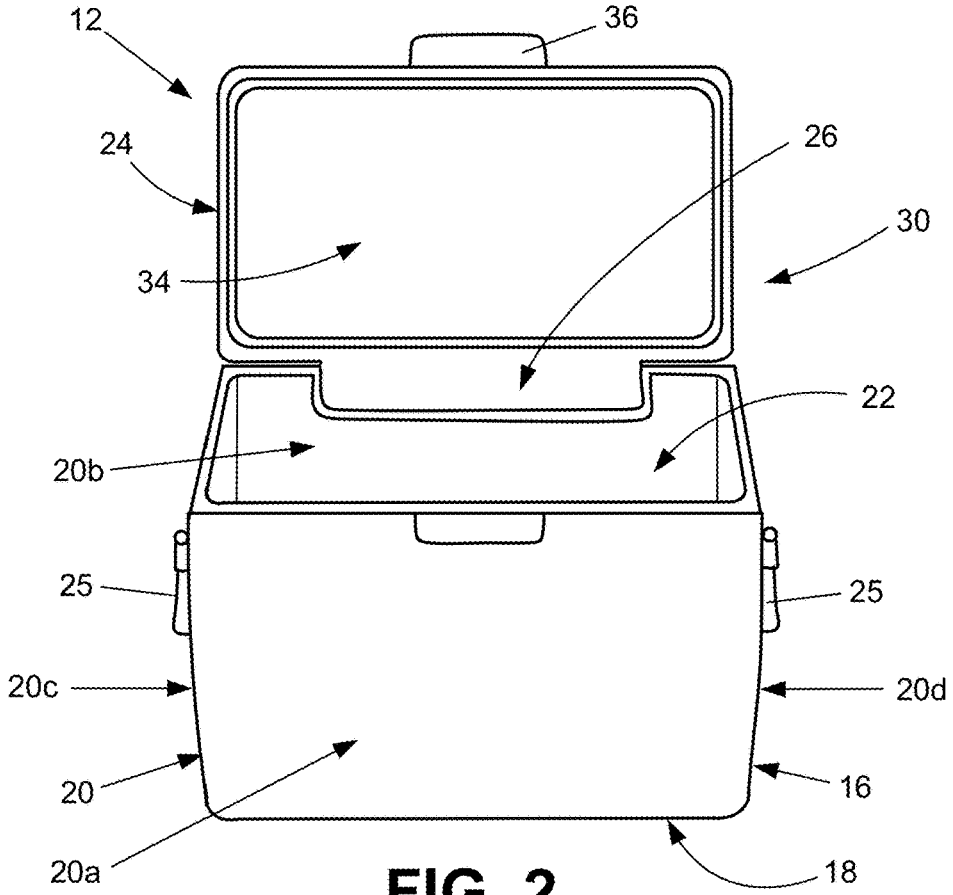
FIG. 2 (PRIOR ART)
FIG. 2 is a front perspective of the prior art container of FIG. 1 with the container lid thereof shown in its open position.
Figure 3:
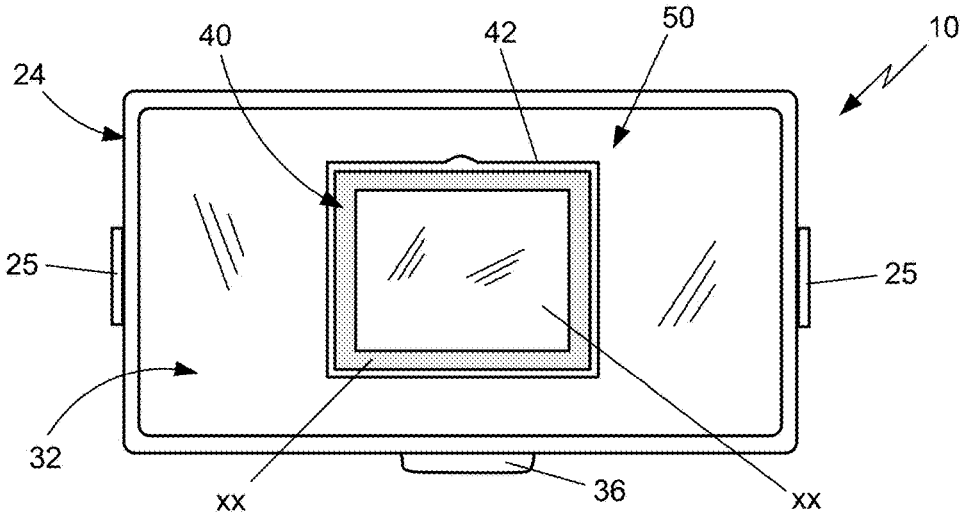
FIG. 3 is a top view a container that is configured according to one of the preferred embodiments of the present invention showing the upper surface of the container lid, a recessed area in the upper surface and a display panel in the recessed area, with the display panel shown in its lowered position.
Figure 4:
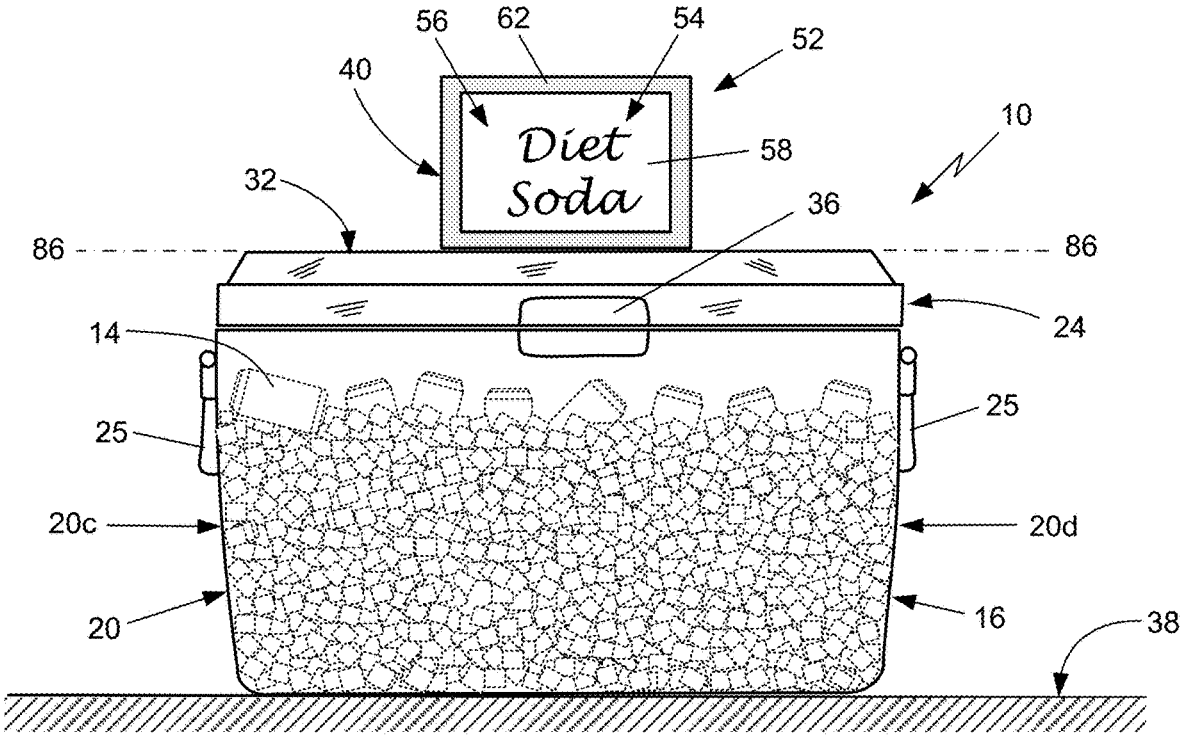
FIG. 4 is a front view of the container of FIG. 3 with the display panel shown in its raised position and an item description on the display surface thereof.
Figure 12:
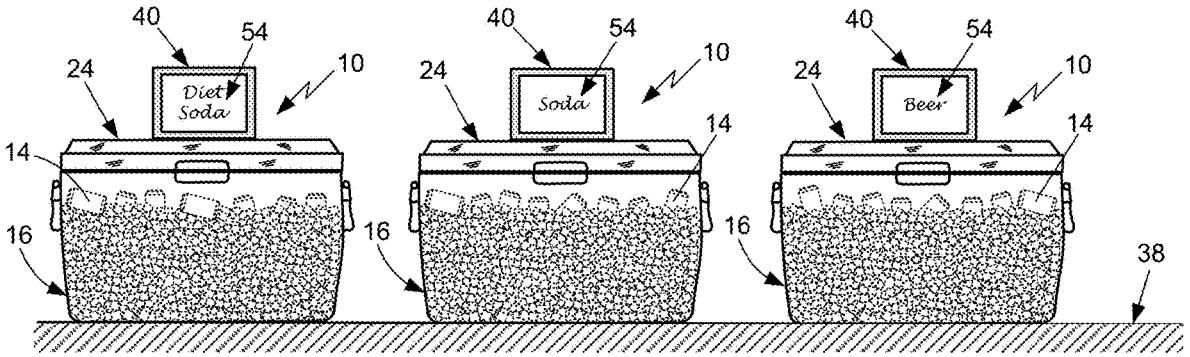
FIG. 12 is an illustration showing the use of three containers of the present invention that are each utilized to store different items.

A new container that is configured pursuant to one or more of the preferred embodiments of the present invention is shown generally as 10 in FIGS. 3-6 and 12. As shown in these figures and set forth in more detail below, the new container 10 of the present invention is structured and arranged to be utilized in generally the same manner as prior art containers 12, an example of which is shown in FIGS. 1-2, to store one or more items 14, examples of which are shown in FIGS. 4 and 12, inside the new container 10 and prior art containers 12. The typical prior art container 12 has a container body 16 comprising a bottom wall 18 and one or more sidewalls 20 that, collectively, define an interior area 22 inside the prior art container 12. In the figures, the prior art container 12 (as well as the new container 10) are shown as having a rectangular configuration with a plurality of sidewalls 20, namely front wall 20*a*, back wall 20*b*, left side wall 20*c* and right side wall 20*d*, as shown in FIGS. 1-2. Prior art containers 12 also has a container lid 24 that engages the sidewalls 20, typically near the upper end thereof, to allow the user thereof to selectively close or open the interior area 22 to enclose any items 14 therein or to allow access to and, as may be desired, placement or removal of the items 14 from the prior art container 12. The typical prior art container 12 will commonly have at least one container body handle 25 that is utilized by the user to help carry or otherwise move the prior art container 12. Commonly, each of the left side wall 20*c* and the right side wall 20*d* will have a container body handle 25, as shown in FIGS. 1-2.

As is well known by persons who are skilled in the relevant art, the container lid 24 may be pivotally attached to one or more of the sidewalls 20 using a container pivot mechanism 26, such as a hinge or the like (as shown in FIG. 2 showing the container pivot mechanism 26 connected to the back wall 20*b*), or the container lid 24 may be of the type which is removably secured to the sidewalls 20 by, as an example, having a portion of the container lid 24 sized and configured to be received in the upper ends of the sidewalls 20. Depending on the anticipated use of the prior art container 12, the sidewalls 20 and the container lid 24 may be cooperatively sized and configured so the container lid 24 will engage the upper end of the sidewalls 20 in a manner which securely closes the interior area 22, with or without items 14 therein. Commonly, the container lid 24 will sealably engage the upper end of the sidewalls 20 to help retain cold or warm temperatures in the interior area 22 of prior art container 12. Whether the container lid 24 is pivotally attached to or removably engaged with the container body 16, the container lid 24 moves between a closed position 28, as shown in FIG. 1, and an open position 30, as shown in FIG. 2. As set forth above and well known to persons who are skilled in the relevant art, when the container lid 24 is in its closed position 28 the interior area 22 is closed to enclose any items 14 inside the prior art container 12 and when the container lid 24 is in its open position 30 the interior area 22 is open, allowing access thereto so one or more items 14 can be placed inside the prior art container 12 and/or removed from the prior art container 12.

As shown in FIGS. 1-2, the container lid 24 has an upper surface 32 and a lower surface 34. When the container lid 24 is in its closed position, the upper surface 32 thereof is typically upwardly disposed and the lower surface 34 is typically downwardly disposed into the interior area 22. For pivotally attached container lids 24, when the container lid 24 is in its open position 30, the upper surface 32 thereof may be facing rearward (as shown in FIG. 2) or downward, depending on the amount of pivot, and the lower surface 34 may be facing forward (as also shown in FIG. 2), downward or rearward, depending on the degree of pivot. Typically, but not always, the container lid 24 has a lid handle 36 that the user will utilize to pivotally raise and lower the container lid 24.

Figure 5:
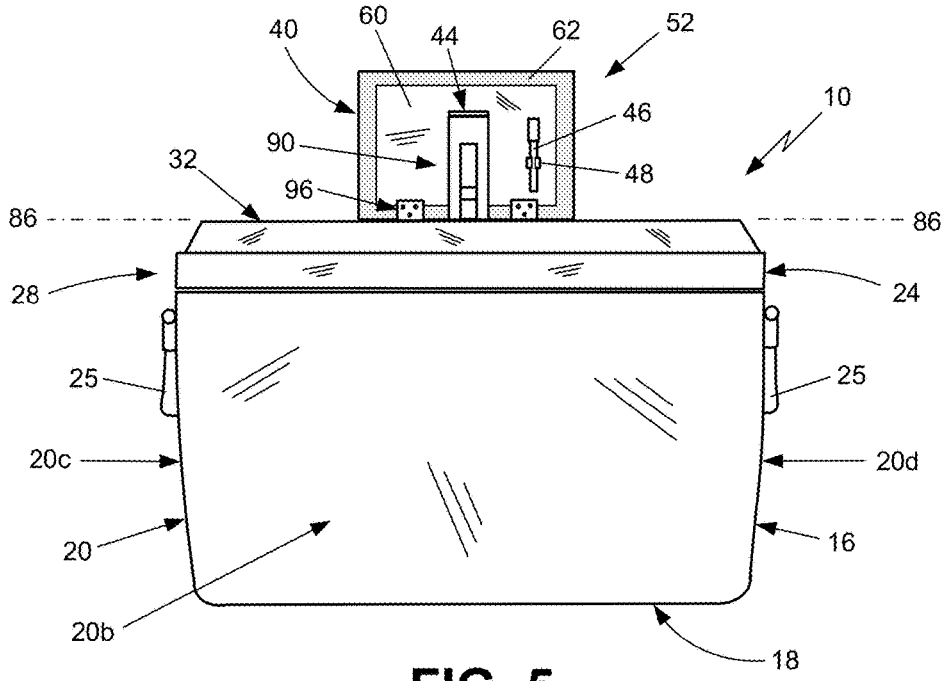
FIG. 5 is a back view of the container of FIG. 4.
Figure 6:
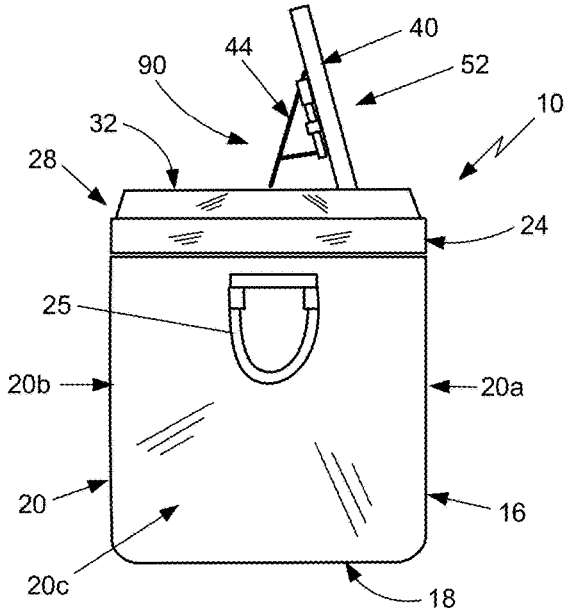
FIG. 6 is a left side view of the container of FIG. 4 particularly showing the support assembly thereof in its extended condition.

For purposes of describing the use and relative location of the various components of the new container 10 of the present invention and the prior art container 12, the terms "front", "forward", "forwardly" and the like are utilized to refer to the direction of the front wall 20*a* facing the reader in FIGS. 1, 2, 4 and 12 and the terms "back", "rearward", "rearwardly" and the like are utilized to refer to the direction of the back wall 20*b* opposite the front wall 20*a* and facing the reader in FIG. 5. The directions "left", "leftward", "right", "rightward" and the like refer to a direction to the left or right when viewed from the perspective of the reader when viewing the front wall 20*a* in FIGS. 1, 2 and 4. The terms "up", "upper", "upward", "upwardly", "top" and the like refer to the direction to or generally toward the container lid 24 and away from the ground, floor or other surface 38 on which the bottom wall 18 of the container body 16 is positioned in FIGS. 4 and 12. Likewise, the terms "down", "downward", "downwardly", "lower", "bottom" and the like refer to the direction toward the bottom wall 18 and toward the ground, floor or other surface on which the bottom wall 18 of the container body 16 is positioned in FIGS. 4 and 12.

As will be readily appreciated by those persons who are skilled in or familiar with the relevant art, as with prior art containers 12, the new container 10 of the present invention can be made out of a wide variety of different materials and in a wide variety of different sizes and shapes. Often, the materials for the container 10 will be selected to accomplish particular storage objectives or in light of the conditions in which the container 10 will be utilized. For instance, the container 10 can be configured as an ice chest with a container body 16 having a bottom wall 18, sidewalls 20 and container lid 24 that are made out of materials and configured to, at least generally, insulate the container 10 so as to maintain as close to as possible a desired temperature, whether cold or warm, inside the interior area 22 of the container 10 (i.e., ice chest) to keep any items 14 therein cold or warm. For instance, FIGS. 4 and 12 show the use of ice inside the interior area 22 to keep the items 14 inside the interior area 22 of the container 10 cold. Such containers 10 are often made out of plastic that fully enclose insulating materials. In other embodiments, the container 10 may be made out of metal, wood, composites and the like depending on the nature of the use of the container 10 and/or the external environment in which the container 10 will be utilized.

The item 14 or items 14 that can be stored inside the interior area 22 is/are virtually unlimited. In the figures accompany the present disclosure, the container 10 is shown with a plurality of cans of liquid beverages (with the ice) as the items 14 that are stored inside the interior area 22 of the container 10 of the present invention, as shown in FIGS. 4 and 12. With regard to FIG. 12, three ice chests (as containers 10) are shown, each with items 14 containing different liquid beverages, namely "Diet Soda", "Soda" and "Beer". The insulated, ice chest type of container 10 can have other types of beverages and/or a wide variety of food, condiments and the like. As well known to persons who use containers 10, the new container 10 can also store a wide variety of non-beverage and non-food related items 14, including medicine, balls, sports equipment, toys, tools, hardware, uniforms and other clothes, papers, office products and the like. As will be readily appreciated by persons who are skilled in the relative art, the storage of virtually any type of item 14 or group of items 14 can be utilized with and benefit from the various features of the present invention that are described in detail below.

The container 10 of the present invention has the various features and components described above and with regard to the prior art container 12, shown in FIGS. 1-2, including the container body 16 and container lid 24. As shown best in FIGS. 3-6, the container body 16 of the new container 10 has a bottom wall 18 and one or more sidewalls 20 that define an interior area 22. As with the prior art container 12, the container lid 24 of the new container 10 can be pivotally attached to one or more of the sidewalls 20 or the container lid 24 can be configured to be removably engaged with the sidewalls 20, typically at or near the upper end of the sidewalls 20. The new container 10 of the present invention also comprises a display panel 40, a recessed area 42 in the upper surface 32 of the container lid 24 and a support assembly 44 that supports the display panel 40 in the recessed area 42 so the display panel 40 can be seen by persons who are standing in front of and generally facing the front wall 20*a* of container body 16, as shown with regard to the reader in FIGS. 4 and 12. In certain embodiments of the present invention, the container 10 also comprises a writing instrument 46 selected to write on the display panel 40 and a clip or other securing mechanism 48 that is configured to secure the writing instrument 46 to the display panel 40. As set forth in more detail below and best shown in FIG. 3, the display panel 40 and the recessed area 42 are cooperatively sized and configured so the display panel 40 can be received in the recessed area 42 when the display panel 40 is not being used to identify the item 14 or items 14 inside the interior area 22 of the container 10. More specifically, the support assembly 44 associated with the display panel 40 and recessed area 42 is structured and arranged to allow the user to move the display panel 40 between a lowered position 50, as shown in FIG. 3, and a raised position 52, shown in FIGS. 4-8 and 12, and to support the display panel 40 in the raised position 52 so people can see the identifying information 54, as shown in FIGS. 4 and 12, that is on the display panel 40, which is selected so as to correspond, in at least a general or collective manner, to the item 14 or items 14 in the interior area 22 of the new container 10.

The display panel 40 for use with the new container 10 of the present invention has at least one outwardly facing display surface 56 that is selected to display the identifying information 54 that identifies the item 14 or items 14 inside the interior area 22 of the container 10. The display panel 40 has at least a front side 58 and a back side 60, as respectively shown in FIGS. 4 and 5, which sides 58/60 generally correspond with, respectively, the front wall 20*a* and the back wall 20*b* of the sidewalls 20 of the container body 16. The embodiment of the new container 10 that is shown in the figures has the display surface 56 on the front or forwardly facing side 58 of the display panel 40, which is likely to be the side that the person wanting an item 14 out of the container 10 will be facing prior to him or her opening or deciding not to open the container lid 24 to remove the item 14 from the interior area 22. Although the back side 60 and the right or left sides of the display panel 40 could also have a display surface 56, it is likely that the front side 58 will be the preferred location for the identifying information 54 and to achieve the objectives (set forth below) pertaining to when the display panel 40 is in its lowered position 50. In the preferred embodiments, the display surface 56 is planar for ease of placing the identifying information 54 thereon, particularly when utilizing a pen or similarly configured writing instrument 46.

The material and/or the coating for the material utilized for the display surface 56 is selected so as to be able to beneficially receive and display the identifying information 54 thereon so as to identify, at least generally by a category, the items 14 inside the container 10. In a likely preferred embodiment, the display surface will be a whiteboard having a surface suitable for use with dry-erase pens or the like as the writing instrument 46. A whiteboard is also know as a dry-erase board or a melamine dry-erase surface. Whiteboards and like surfaces are very commonly utilized in classrooms, conference rooms, offices and the like to allow the user thereof to write data or other information thereon and then relatively easily remove (erase) the information from the surface so new information can be written on the surface. In addition to the ease of use and readily known and available writing instruments 46, whiteboards are generally able to withstand the anticipated use and environmental exposure for the container 10. Alternatively, the display surface 56 can be a chalkboard type surface, a paper pad type surface, a magnetic surface or even an electronic display surface.

In many embodiments, it may suitable for the display panel 40 to be comprised of entirely the display surface 56. In the embodiment shown in the figures, however, the display panel 40 comprises a peripherally disposed frame 62 around the display surface 56. As will be readily appreciated by persons who are familiar with various display surfaces, especially whiteboard surfaces and the like, the display panel 40 can structurally benefit from having a peripherally disposed frame 62. In addition, the frame 62 provides an area of the display panel 40 that can be grasped or otherwise handled by the users without possibly damaging the display surface 56 due to exposure to body oils and contaminants, including dirt, liquids and the like, that may be on the user's hands when he or she handles the display panel 40. Often, frames 62 can also be selected for aesthetic purposes so as to enhance the overall visual appearance of the display panel 40.

As will be readily appreciated by persons who use ice chests and other containers, a container such as the new container 10 is likely to be utilized, at least to some extent, in an outdoor environment, in a vehicle and/or other locations where the container 10 will be exposed to heat, cold, wind and other weather elements. As such, the various components of the display panel 40 are preferably made out of materials that are selected to be waterproof and otherwise generally resistant to degradation by its exposure to the sun, rain, snow, dirt, heat, cold, wind and other atmospheric and/or weather conditions.

The display panel 40 needs to be dimensioned in at least a somewhat corresponding relation to the dimensions of the recessed area 42 so that the display panel 40 so the user will be able to relatively easily move the display panel 40 between its lowered position 50 inside the recessed area 42 and its raised position 52, as supported by the support assembly 44, so the display surface 56 can be seen by a person standing in front, preferably, of the front wall 20*a* of the container body 16 prior to him or her accessing the interior area 22 of the container 10. In one embodiment, the dimensions of the display panel 40 and the recessed area 42 can be selected such that the relevant dimensions of the display panel 40 are slightly less than the corresponding dimensions of the recessed area 42, such as shown in FIG. 3, so the user can easily utilized his or her fingers to lift up and lower the display panel 40 relative to the recessed area 42.

Figure 7:
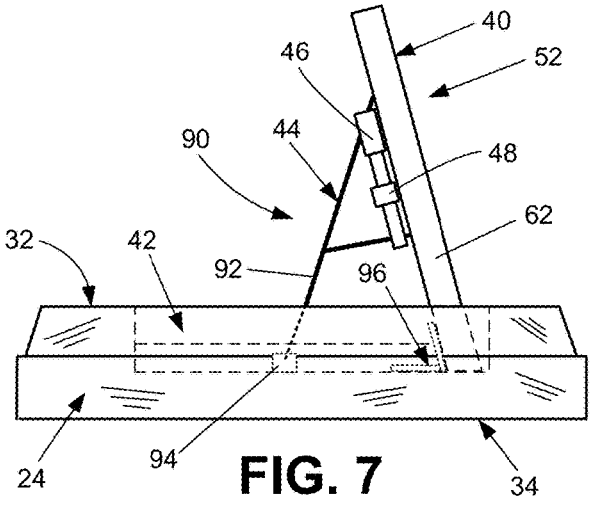
FIG. 7 is an enlarged left side view of the container lid, display panel and support assembly of FIG. 6.
Figure 9:
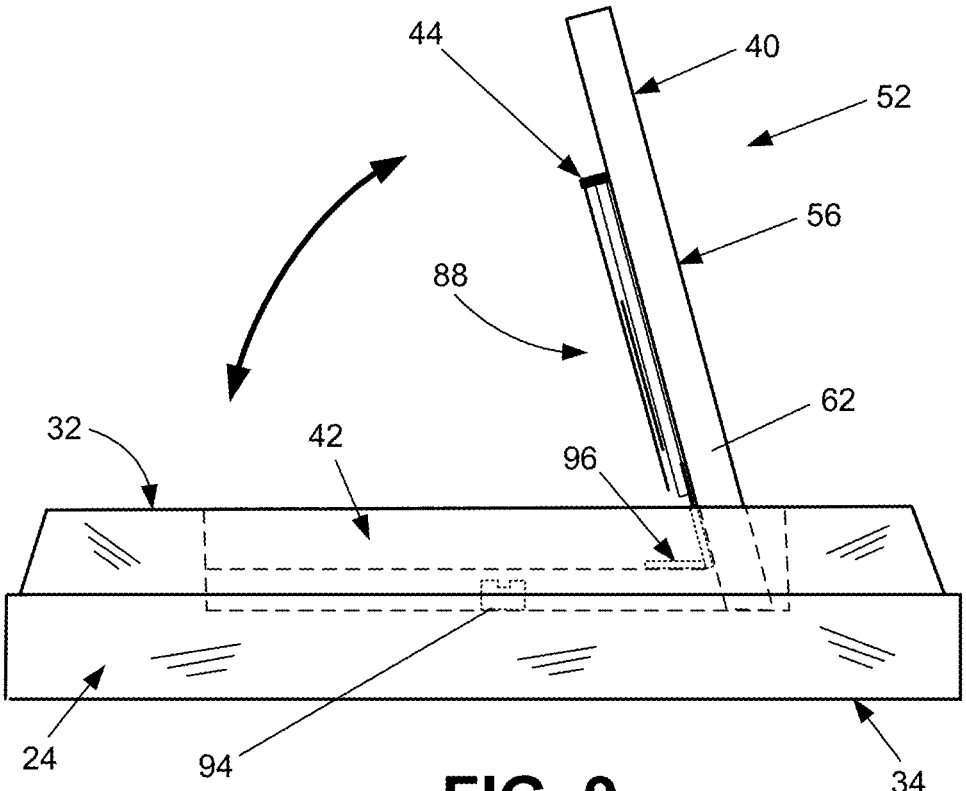
FIG. 9 is left side of the container lid, display panel and support assembly of FIG. 7 shown without the writing instrument and with the support assembly in its collapsed condition while raising or lowering the display panel.
Figure 10:
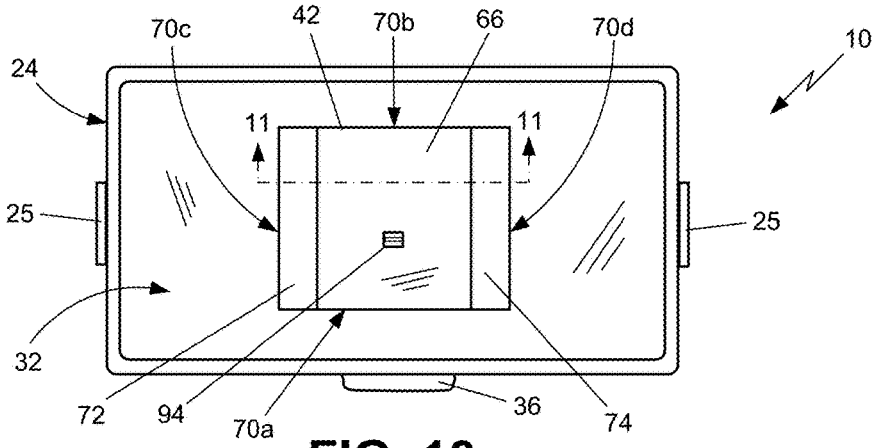
FIG. 10 is a top view of the container of FIG. 3 shown without the display panel to better illustrate the recessed area of the container lid.
Figure 11:
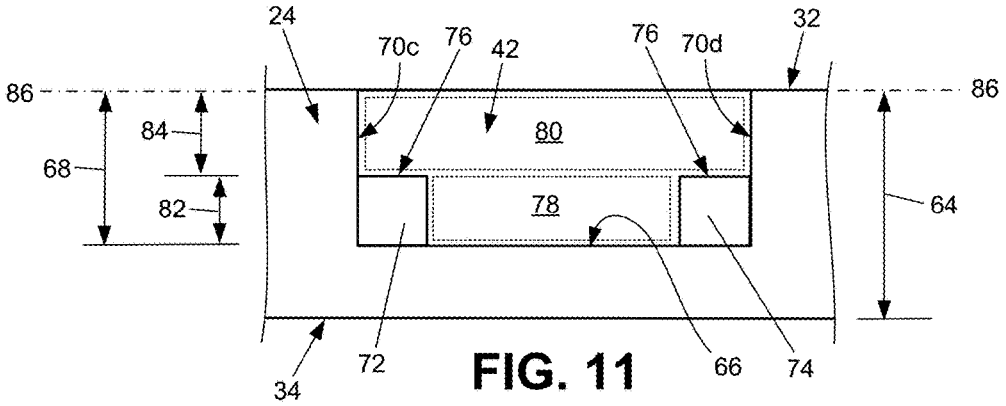
FIG. 11 is a cross-sectional front view of the recessed area of the container lid of FIG. 10 taken through lines 11-11 thereof.

As set forth above, the recessed area 42 is a cut-out section of the container lid 24, which has a lid thickness 64 between the upper surface 32 and the lower surface 34 thereof, as shown in FIG. 11. The "bottom" of the recessed area 42 comprises a lower or recess surface 66. As set forth in more detail below, in the embodiment of the new container 10 of the present invention shown in the figures, the support assembly 44 interconnects, directly or indirectly, the back side 60 of display panel 40 with the recess surface 66 of the recessed area when the display panel 40 is in its raised position 52, as shown in FIGS. 7 and 9. The depth of the recessed area, the recess depth 68 measured from the upper surface 32 to the recess surface 66, should be sufficiently less than the lid thickness 64, as best shown in FIG. 11, to prevent any penetration through the lower surface 34 of the container lid 24 that will affect the structural integrity of the container lid 24 and/or the ability of the container 10 to keep items 14 in the interior area 22 cold or warm. As shown in FIGS. 10 and 11, the recessed area 42 has one or more sidewalls 70 that define the dimensions of the recessed area 42. In the embodiment shown in the figures, the recessed area 42 has four sidewalls 70, namely a front wall 70*a*, a back wall 70*b*, a left side wall 70*c* and a right side wall 70*d*, which sidewalls 70 correspond in position to the sidewalls 20 of the container body 16.

Figure 13:
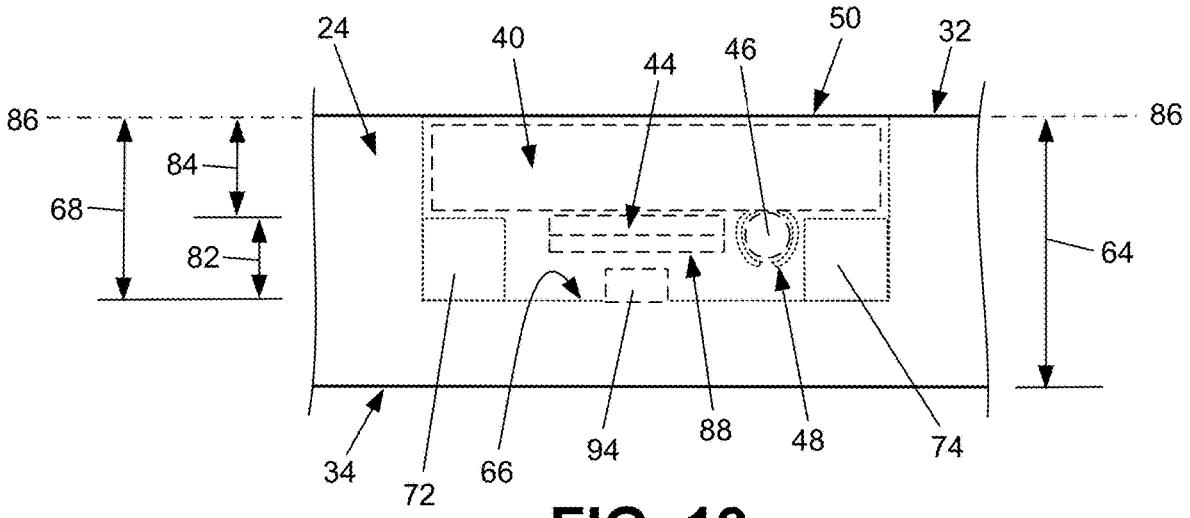
FIG. 13 is a partial front view of the container lid showing the display panel in its lowered position in an upper cavity of the recessed area and the support assembly, writing instrument and securing mechanism is lower cavity of the recessed area.

As also shown in FIG. 11, adjacent to the left sidewall 70*c* is a first raised section 72 and adjacent the right sidewall 70*d* is a second raised section 74. Both of the raised sections 72/74 define a raised surface 76 that is disposed in spaced apart relation above the recess surface 66, as best shown in FIG. 11. As shown in this figure, the raised sections 72/74 effectively separate the recessed area 42 into a first or lower cavity 78 and a second or upper cavity 80. The first/lower cavity 78 has a first cavity depth 82 that is measured between the raised surface 76 and recess surface 66 and the second/upper cavity 80 has a second cavity depth 84 that is measured between the upper surface 32 of the container lid 24 and raised surface 76, as best shown in FIG. 11. In the embodiment of the new container 10 shown in the figures, the first/lower cavity 78 is sized and configured to receive and store the support assembly 44, writing instrument 46 and securing mechanism 48 and the second/upper cavity 80 is sized and configured to receive and store the display panel 40 with the back side 60 thereof placed on top of the raised surface 76 when the display panel 40 is in its lowered position 50 inside the recessed area 42, as shown in FIG. 13. With regard to the second/upper cavity 80, the second cavity depth 84 is selected such that the entire display panel 40, typically with the display surface 56 facing upward as shown in FIG. 3, will be below the lid plane, shown as 86 in FIGS. 4-5, 11 and 13, along the upper surface 32 of the container lid 24, as shown in FIG. 13. In this configuration, the display panel 40 and the associated components will be below the lid plane 86 through the upper surface 32 so that if any objects or materials, including another container, is placed on the upper surface 32 of the container lid of the container 10, it will not damage the display panel 40, the other object or materials and/or any of the containers (including new container 10). One advantage of this configuration is that multiple containers, whether new container 10 or a prior art container 12, can be stacked on top of each other during storage or transport of the containers 10/12. As will be readily appreciated by persons familiar with prior art containers 12, the items 14 and anything else placed in the interior area 22 and the weight of the prior art container 12 itself (which is also applicable to the new container 10) can be quite significant and could easily damage an exposed (i.e., above the lid plane 86) display panel 40 and the associated components.

As set forth above, the container 10 of the present invention also has a support assembly 44 that is utilized to support the display panel 40 in its raised position 52, as shown in FIGS. 4-9 and 12-15. The support assembly 44 of the new container 10 is structured and arranged to move between a collapsed condition 88 and an expanded condition 90, as shown with regard to FIGS. 5-9 and 13-15. With the support assembly 44 in its collapsed condition 88, shown in FIGS. 9 and 13, the user can move the display panel 40 to its lowered position 50 and place the display panel 40, with support assembly 44, in the recessed area 42, as best shown in FIG. 13. As set forth above and shown in FIG. 13, the support assembly is stored in the first/lower cavity 78 and the display panel 40 is stored in the second/upper cavity 80. The support assembly 44 should be configured such that when the support assembly 44 is in its expanded condition 90, as shown in FIGS. 5-8 and 14-15, the support members 92 thereof will be able to support the display plane 40 in its raised position 52 so people in front of the container 10 will be able to see the identifying information 54, as shown in FIGS. 4 and 12, and know what items 14 are stored in the interior area 22 of the container 10 without having to unnecessarily raise or remove the container lid 22.

In the embodiments which are shown in the figures, a portion of the support assembly 44 is attached to or integral with the back side 60 of the display panel 40 so as to move with the display panel 40 as the user selectively moves the display panel 40 between its lowered position 50 and its raised position 52, as exemplified with regard to FIGS. 3 and 4. In this configuration, when the user raises the display panel 40 to its raised position 52, he or she will then move the support assembly 44 from its collapsed condition 88 to its expanded condition 90 to support the display panel 40 in the raised position 52 so people can clearly see the identifying information 54 on the display surface 56 on the front side 58 of the display panel 40, as shown in FIGS. 4 and 12. When the support assembly 44 is in its expanded condition 90 it interconnects the display panel 40 and the container lid 24 to support the display panel 40 in the raised position 52. In the embodiments shown in the figures, the support assembly 44 interconnects, directly or indirectly, the display panel 40 and a portion of the recessed area 42, such as the recess surface 66, as shown in FIG. 7.

Figure 8:
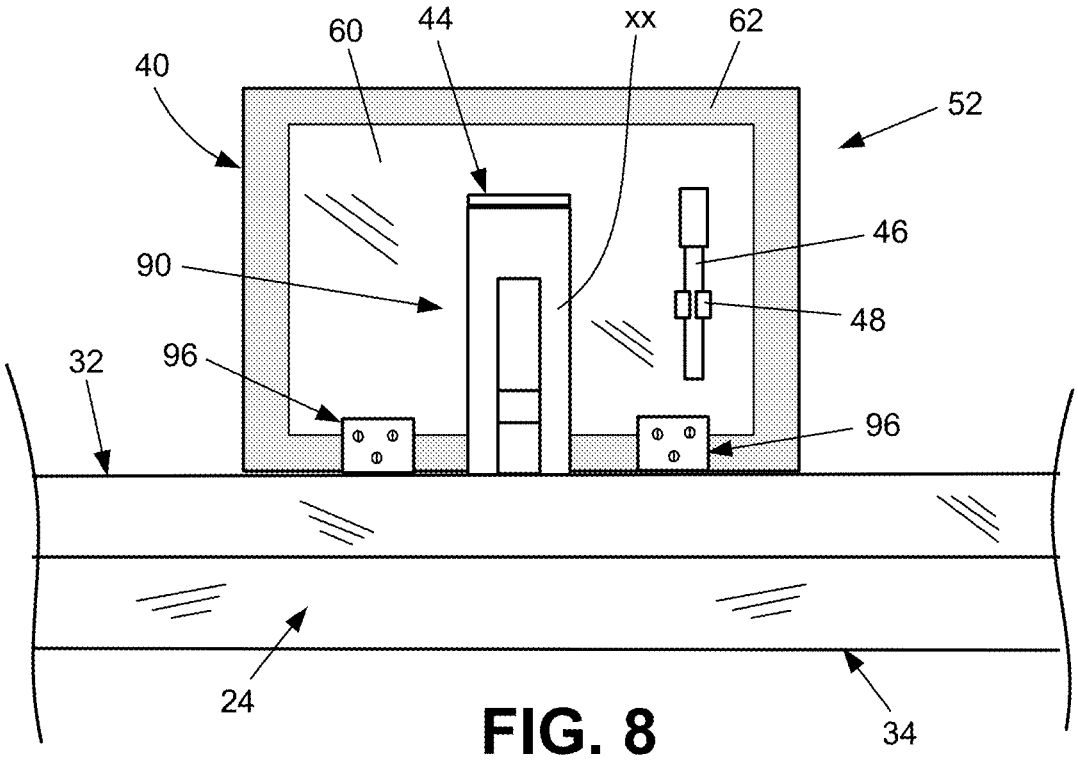
FIG. 8 is a back view of the container lid, display panel and support assembly of FIG. 7.
Figure 14:
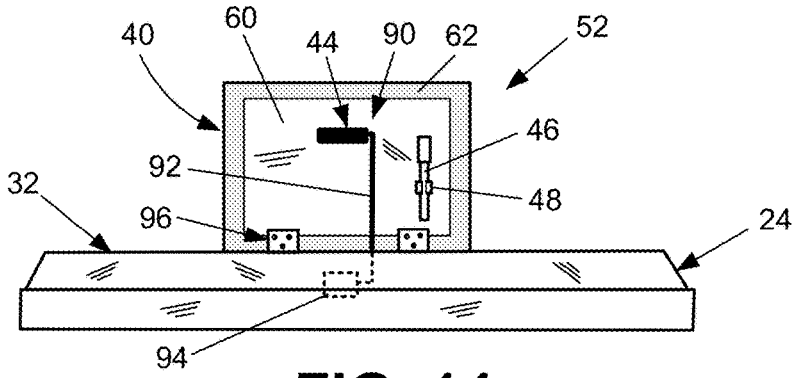
FIG. 14 is a back view of the container lid of the container of FIG. 3 showing the display panel in its raised position utilizing an alternative configuration for the support assembly.
Figure 15:
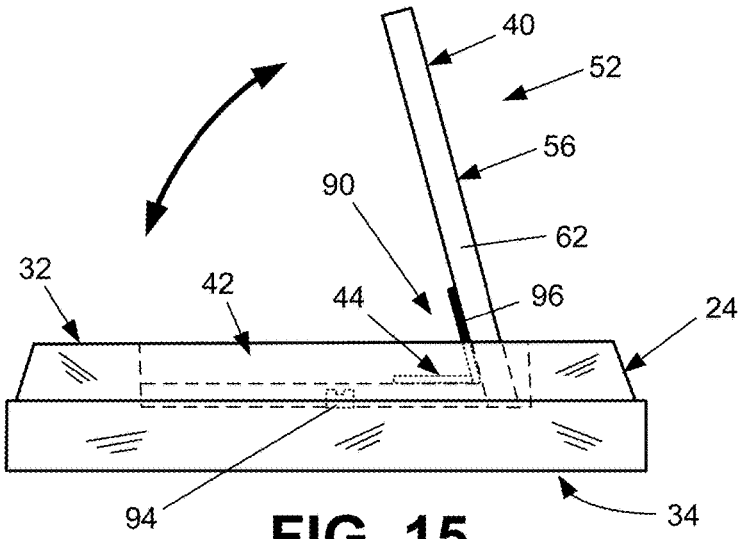
FIG. 15 is a side view of the container lid of the container of FIG. 3 showing locking hinges being utilized as the support mechanism to support the display panel in its raised position.

To accomplish the above, the support assembly has one or more rigid support members 92, shown in FIGS. 7-8, that are selected and configured to support the display panel 40 in its raised position 52. In one configuration, the support assembly 92 is configured similar to the typical "stands" that are utilized to support frames which are unfolded or otherwise assembled to display photographs, artwork and the like on a horizontally disposed surface. Such a stand-like support assembly 44 is shown in FIGS. 5-9 and 13. An example of a support assembly 44 comprising a single, elongated support member 92 is shown in FIG. 14. In a preferred embodiment of the new container 10, the support assembly 44 is cooperatively configured with an engagement member 94 that is positioned in the recessed area 42, such as on the recess surface 66, of the container lid 24, such as shown in FIGS. 5, 7, 9-10 and 13-14. In the embodiment shown in FIGS. 5-9 and 13, the engagement member 94 has a slot or the like opening that is sized and configured to receive a horizontally disposed support member 92 of the support assembly 44. In the embodiment of FIG. 14, the engagement member 94 has an aperture that receives a horizontally disposed segment of the single support member 92. As will be readily appreciated by persons skilled in the art, the engagement member 94 is sized and configured to be engaged by the support assembly 44 in a manner which supports the display panel 40 in its raised position 52 so it will not easily fall over due to the wind, a bump against the container 10, the waging tail of a dog or like occurrences. The engagement member 94 can take on any size and configuration which is suitable for engaging and supporting the display panel 40 by the support assembly 44 and able to fit below the display panel 40 when the display panel 40 is in its lowered position 50, as shown in FIG. 13.

Although the support assembly 44 is shown in the figures as being attached to or integral with the back side 60 of the display panel 40 and extending to connect to a single engagement member 94 on the recess surface 66 of the container lid 24, persons who are skilled in the relevant art will readily appreciate that the present invention is not so limited. For instance, the support assembly 44 can be attached to or integral with the recess surface 62 (instead of the display panel 40) and configured to extend or unfold upward to connect to the back side 60 of the display panel 40 or to an engagement member 94 on the back side 60 of the display panel 40, effectively being the reverse of the configuration shown in the figures. Alternatively, the support assembly 44 can connect an area of the display panel 40 other than the back side 60 thereof to a different area of the container lid 24, including other locations of the recessed area 22. Persons who are skilled in the relevant art, will readily appreciate that the support assembly 44 is subject to a wide range of different configurations and to a wide range of manners of engaging the support assembly 44 with the display panel 40 and the container lid 24.

In the embodiment shown in the figures, the new container 10 also utilizes one or more pivot members 96, such as hinges or the like, that are sized and configured to secure the display panel 40 to the container lid 24 and allow the user to pivot the display panel 40 between its lowered position 50 and its raised position 52, such as shown in FIGS. 5 and 7-9. The pivot members 96 shown in the figures connect the display panel 40 to the recessed area 42 so as to allow the display panel 40 to both be securely attach the display panel 40 to the container lid 24 and allow the display panel 40 to pivot up and down relative to the container lid 24. In another embodiment, shown in FIG. 15, the pivot members 96 also function as the support assembly 44 by automatically, but securely, locking in an upward pivoted position when the display panel 40 is moved to its raised position 52. In this embodiment, the pivot member support assembly 44 will require the user to apply sufficient force to the display panel 40 overcome the "locking" of the support assembly 44 to push the display panel 40 down to its lowered position 50. Persons who are skilled in the relevant art will be readily familiar with hinges and like pivot members 96 that are commonly utilized to allow a user to pivot open and then keep open a door, often cabinet doors and the like, while the user accesses the interior of a cabinet or the like. These "locking" hinges can be utilized as pivot members 96 which function as the support assembly 44 to support the display panel 40 in its raised position 52, as shown in FIG. 16.

The writing instrument 46, which may or may not be included with the new container 10, is selected to allow the user to be able to write the identifying information 54 on the display surface 56 of the display panel 40. For instance, in a preferred embodiment where the display panel 40 comprises a dry-erase board or dry-erase surface, the writing instrument 46 is a dry-erase pen that is of the type which allows the user to easily wipe the display surface 56 clean, using with cloth, rag, eraser or the like, to replace one set of identifying information 54 with other identifying information 54 to reflect different items 14 being stored in the interior area 22 of the container 10. In the embodiment where the display surface 56 is or comprises a chalkboard, the writing instrument 46 can be a piece of chalk or the like which can write the identifying information 54 on the display surface 56 and then allow the user to remove the identifying information 54. In the embodiment where the display surface 56 is or comprises paper or like material, the writing instrument 46 can be a pen, pencil, marker or the like. In any embodiment of the new container 10 that uses a writing instrument 46 and a securing mechanism 48 to secure the writing instrument 46 to the display frame 40 (or container lid 24 or on the container body 16), the securing mechanism 48 should be structured and arranged to removably secure the writing instrument 46 to the display panel 40, typically the back side 60 (as shown) or the frame 62 thereof, or to the container lid 24 or container body 16. In one embodiment, the securing mechanism 48 is a clip or clip-like member that allows the user to press the writing instrument 46 into the securing mechanism 48 to secure the writing instrument 46 in place and to pull the writing instrument 46 out of the securing mechanism 48 when he or she desires to write the identifying information 54 on display surface 56. In other embodiments, the securing mechanism 48 can be a magnet, a magnetically attachable element (such as a ferromagnetic plate or the like), one-half of a piece of hook-and-loop connectors (i.e., Velcro®) that is selected to correspond to components of or on the writing instrument 46.

In use, the new container 10 of the present invention will have the display panel 40 thereof in its lowered position 50. The user then selects the type of items 14 to be stored in the container 10 and, at some point in time, places the items 14 in the interior area 22 of the container 10. Before or after moving the display panel 40 to its raised position 52, the user will place identifying information 54 on the display surface 56 of the display panel 40. In the embodiments where there is a writing instrument 46 that is secured to the display panel 40, container lid 24 or container body 16 with a securing mechanism 48, the user will remove the writing instrument 46 from the securing mechanism 48 and write the identifying information 54 on the display surface 56 of the display panel 40 utilizing the writing instrument 46. Typically, the user will then re-secure the writing instrument 46 to the securing mechanism 48. If the display panel 40 is not already in the raised position 52, the user will move the display panel 40 to the raised position 52 and, as may be necessary, unfold or otherwise move the support mechanism 44 into its expanded condition 90 and utilize the support mechanism 44 to support the display panel 40 in its raised position 52, as shown in FIGS. 4-8, 12 and 14-15. Persons approaching the new container 10 will be able to readily determine what items 14 or general type of items 14 are inside the interior area 22 of the container 10, which will be particularly beneficial when there are multiple containers 10 (as shown in FIG. 12). When the container 10 is no longer needed, the user can place the support mechanism 44 in its collapsed condition 88 and move the display panel 40 to its lowered position 50 inside the recessed area 42, as shown in FIGS. 3 and 13. Before or after placing the display panel 40 in its lowered position 40, the user will use, typically, an appropriate item (such as an eraser, rag, towel or the like) to remove the identifying information 54 from the display surface 56 to prepare the container 10 for future use. Because the display panel 40 is below the lid plane 86 along the upper surface 32 of the container lid 24 when the display panel 40 is in its lowered position, as shown in FIG. 13, the user can stack containers 10 or otherwise place objects on top of the container lid 24 without damaging the display panel 40 or the components associated with the display panel 40.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there may be numerous components of the embodiments described herein that can be readily replaced with equivalent functioning components to accomplish the objectives and obtain the desired aspects of the present invention. The various embodiments set forth herein are intended to explain the best mode of making and using the present invention as currently known to and appreciated by the present inventor(s) and to enable other persons who are skilled in the relevant art to make and utilize the present invention. Although, the described embodiments may comprise different features, not all of these features are required in all embodiments of the present invention. More specifically, as will be readily appreciated by persons who are skilled in the art, certain embodiments of the present invention only utilize some of the features and/or combinations of features disclosed herein.

What is claimed is:

1. A container, comprising:

a container body having one or more sidewalls that define an interior area inside said container body for receiving one or more items therein;

a container lid that is sized and configured to engage said container body to enclose the one or more items inside said interior area, said container lid having an upper surface and a lower surface, said upper surface of said container lid defining a lid plane along said upper surface;

a recessed area in said upper surface of said container lid, said recessed area having one or more sidewalls that define a recess surface in spaced apart relation below said lid plane of said container lid, said recessed area having one or more raised sections that define an upper cavity and a lower cavity;

a display panel sized and configured to be received in said recessed area of said container lid when said display panel is in a lowered position, said display panel having an outwardly facing display surface on which can be placed identifying information that is selected to identify items which to be placed inside said interior area of said container; and a support assembly associated with each of said display panel and said container, said support assembly structured and arranged to selectively support said display panel in a raised position above said container lid so as to display the identifying information on said display surface, wherein said upper cavity is sized and configured to receive said display panel therein when said display panel is in said lowered position and placed on a raised surface on at least one of said one or more raised sections to dispose said lower cavity between said display panel and said recess surface.

2. The container of claim 1, wherein said display panel is sized and configured to be at least substantially horizontally disposed in said recessed area of said container lid when said display panel is in said lowed position.

3. The container of claim 2, wherein recessed area is sized and configured such that said display panel is positioned below the lid plane along said upper surface of said container lid.

4. The container of claim 1, wherein said lower cavity is sized and configured to store said support assembly therein.

5. The container of claim 4, wherein said support assembly is attached to or integral with at least one of said recess surface and said display panel.

6. The container of claim 4, wherein said container further comprises a writing instrument and a securing mechanism for securing said writing instrument to a back side of said display panel, said lower cavity sized and configured to receive said writing instrument and said securing mechanism therein.

7. The container of claim 1, wherein the identifying information being at least generally in corresponding relation to the items to be place in said interior area of said container.

8. The container of claim 1, wherein said support assembly is attached to or integral with at least one of said recessed area and said display panel.

9. The container of claim 8, wherein said support assembly is attached to or integral with at least one of said recess surface and a back side said display panel.

10. The container of claim 1, wherein said container further comprises a writing instrument and a securing mechanism for securing said writing instrument to said display panel, said recessed area sized and configured to receive said writing instrument and said securing mechanism therein.

11. The container of claim 1, wherein said support assembly is structured and arranged to be placed in a collapsed condition for storing said support assembly when said display panel is in said lowered position and in an extended condition for supporting said display panel in said raised position.

12. A container, comprising:

a container body having one or more sidewalls that define an interior area inside said container body for receiving one or more items therein;

a container lid that is sized and configured to engage said container body to enclose the one or more items inside said interior area, said container lid having an upper surface and a lower surface, said upper surface of said container lid defining a lid plane along said upper surface;

a recessed area in said upper surface of said container lid, said recessed area having one or more sidewalls that define a recess surface in spaced apart relation below said lid plane of said container lid, said recessed area having one or more raised sections that define an upper cavity and a lower cavity;

a display panel sized and configured to be receive in and at least substantially horizontally disposed in said recessed area of said container lid when said display panel is in a lowered position, said display panel having an outwardly facing display surface on which can be placed identifying information that is selected to identify items which to be placed inside said interior area of said container; and a support assembly attached to or integral with at least one of said recessed area and said display panel, said support assembly structured and arranged to selectively support said display panel in a raised position above said container lid so as to display the identifying information on said display surface, said support assembly being further structured and arranged to be placed in a collapsed condition for storing said support assembly in said recessed area when said display panel is in said lowered position and placed in an extended condition for supporting said display panel in said raised position, wherein the identifying information on said display surface is at least generally in corresponding relation to the items to be place in said interior area of said container and said upper cavity is sized and configured to receive said display panel therein when said display panel is in said lowered position and placed on a raised surface on at least one of said one or more raised sections to dispose said lower cavity between said display panel and said recess surface.

13. The container of claim 12, wherein recessed area is sized and configured such that said display panel is positioned below the lid plane along said upper surface of said container lid.

14. The container of claim 12, wherein said lower cavity is sized and configured to store said support assembly therein.

15. The container of claim 14, wherein said container further comprises a writing instrument selected so as to write the identifying information on the display surface of said display panel and a securing mechanism that is sized and configured to secure said writing instrument to a back side of said display panel, said lower cavity sized and configured to receive said writing instrument and said securing mechanism therein.

16. The container of claim 12, wherein said container further comprises a writing instrument selected so as to write the identifying information on the display surface of said display panel and a securing mechanism that is structured and arranged to secure said writing instrument to said display panel, said recessed area being sized and configured to receive said writing instrument and said securing mechanism therein when said display panel is in said lowered position.

17. A container, comprising:

a container body having one or more sidewalls that define an interior area inside said container body for receiving one or more items therein;

a container lid that is sized and configured to engage said container body to enclose the one or more items inside said interior area, said container lid having an upper surface and a lower surface, said upper surface of said container lid defining a lid plane along said upper surface;

a recessed area in said upper surface of said container lid, said recessed area having one or more sidewalls that define a recess surface in spaced apart relation below said lid plane of said container lid, said recessed area having one or more raised sections that define an upper cavity and a lower cavity;

a display panel sized and configured to be receive in and at least substantially horizontally disposed in said recessed area of said container lid when said display panel is in a lowered position, said display panel having an outwardly facing display surface on which can be placed identifying information that is selected to identify items which to be placed inside said interior area of said container, the identifying information on said display surface is at least generally in corresponding relation to the items to be place in said interior area of said container;

a support assembly attached to or integral with at least one of said recessed area and said display panel, said support assembly structured and arranged to selectively support said display panel in a raised position above said container lid so as to display the identifying information on said display surface, said support assembly being further structured and arranged to be placed in a collapsed condition for storing said support assembly in said recessed area when said display panel is in said lowered position and placed in an extended condition for supporting said display panel in said raised position;

a writing instrument selected so as to write the identifying information on the display surface of said display panel; and a securing mechanism structured and arranged to secure said writing instrument to said display panel, said recessed area sized and configured to receive said writing instrument and said securing mechanism therein when said display panel is in said lowered position, wherein said upper cavity is sized and configured to receive said display panel therein when said display panel is in said lowered position and placed on a raised surface on at least one of said one or more raised sections to dispose said lower cavity between said display panel and said recess surface, said lower cavity sized and configured to store said support assembly, said writing instrument and said securing mechanism therein when said display panel is in said lowered position.

* * * * *